US007614532B1

(12) United States Patent
Dague

(10) Patent No.: US 7,614,532 B1
(45) Date of Patent: Nov. 10, 2009

(54) BOTTLE CARRIER

(76) Inventor: Elwood D. Dague, 2239 S. Mead, Wichita, KS (US) 67211

( * ) Notice: Subject to any disclaimer, the term of this patent is extended or adjusted under 35 U.S.C. 154(b) by 515 days.

(21) Appl. No.: 11/192,385

(22) Filed: Jul. 28, 2005

(51) Int. Cl.
*A45C 1/04* (2006.01)
*A01K 97/04* (2006.01)

(52) U.S. Cl. ..... 224/148.7; 224/666; 224/667; 224/197

(58) Field of Classification Search ..... 224/148.7, 224/666, 667, 185, 618, 197, 616
See application file for complete search history.

(56) References Cited

U.S. PATENT DOCUMENTS 924,348 A * 6/1909 Green ..... 232/41 E
5,823,496 A * 10/1998 Foley et al. ..... 248/314
5,996,957 A * 12/1999 Kurtz ..... 248/311.2
6,006,966 A * 12/1999 Voisin, Jr. ..... 224/148.4
6,352,235 B2 * 3/2002 Cizek ..... 248/692
2005/0127120 A1 * 6/2005 Pablo ..... 224/148.4

FOREIGN PATENT DOCUMENTS

DE 20001408 U1 * 4/2000

* cited by examiner

*Primary Examiner*—Nathan J Newhouse
*Assistant Examiner*—Lester L Vanterpool
(74) *Attorney, Agent, or Firm*—Kenneth H. Jack; Davis & Jack, L.L.C.

(57) ABSTRACT

A bottle carrier having a stay, the stay having an upper end, a lower end, and having front and rear faces; the bottle carrier further having a bottle support arm, the bottle support arm having rearward and forward ends; the bottle carrier further having a bottle neck receiving "C" clip fixedly attached to or formed wholly with the bottle support arm's forward end; and the bottle carrier further having an arm attaching and torque relieving eye and swivel pin combination fixedly attached to or formed wholly with the respective upper and rearward ends of the stay and the bottle support arms, the eye and swivel pin combination forwardly cantilevering the bottle support arm from the stay.

8 Claims, 5 Drawing Sheets

42
18
44
22
24
26
30
16
40
28
38

BOTTLE CARRIER

FIELD OF THE INVENTION

This invention relates to personally worn accoutrements and apparatus which are adapted for hands free carriage of drinking bottles.

BACKGROUND OF THE INVENTION

Bottle carriers of the type disclosed in U.S. Pat. No. D423,774 issued May 2, 2000 to Peterson are known, such bottle carriers typically comprising a vertically extending pocket or belt engaging stay member, a cantilevered arm extending laterally from the upper end of the stay, and a bottle neck receiving "C" clip fixedly attached or formed wholly with the distal end of the cantilevered arm. In operation of such prior art, bottle carriers a user may grasp the bottle carrier and may extend the carrier's stay element downwardly into, for example, the user's pant's hip pocket opening. Thereafter, the user may nestingly rearwardly insert the neck of a water bottle or soft drink bottle into the forward opening of the carrier's "C" clip, causing the carrier to grasp, retain and suspend the bottle.

Drawbacks or deficiencies of the above described prior art bottle carriers noticeably arise when a user seats him or herself upon a chair or bench. Upon seating, a lower end of a bottle held by the carrier may angularly bias against the seat's surface, twisting the bottle forwardly or rearwardly. Such biasing contact often causes the bottle's neck to impart rotational torque to the "C" clip's left and right fingers undesirably counter-levering the bottle's neck against such fingers and resulting in premature disengagement of the bottle from the "C" clip. Such drawbacks and deficiencies also noticeably arise upon swift walking or running which similarly causes angular swinging of the bottle, which similarly imposes torque upon the "C" clip, undesirably prematurely disengaging the bottle.

The instant inventive bottle carrier solves or ameliorates the drawbacks and deficiencies of prior art bottle carriers noted above by incorporating mechanical structures which allow the carrier's arm attaching means to dually or additionally function as a torque relieving means. Such additional functionality allows the carrier's "C" clip element to consistently grasp and hold a bottle's neck while the bottle experiences twisting or torquing forces arising during seating, walking, or running.

BRIEF SUMMARY OF THE INVENTION

A structural component of the instant inventive bottle carrier comprises a stay having upper and lower ends, and preferably having front and rear faces. Preferably, the stay is vertically oblongated, and is cylindrical, having a substantially rectangular horizontal cross-sectional profile. The stay element is preferably plastic injection molded, and is preferably sized for convenient insertion in to a pants hip pocket, or beneath a user's belt. Suitably, the stay element may alternately comprise a plastic or wire frame structure.

A preferred vertical length of the stay element 4" to 5", a preferred lateral width of the stay element is ¾" to 1", and a preferred front to rear dimension of the stay element is ⅛" to ¼". Preferably, corners at the lower end of the stay are relieved or rounded for avoidance of snagging or binding against fabric surfaces upon insertion behind a belt or into pants pocket.

A further structural component of the instant inventive bottle carrier comprises a bottle support arm which, like the stay element, preferably comprises injection molded plastic. A bottle neck receiving "C" clip is preferably fixedly attached to or formed wholly with the forward end of the bottle support arm element. The forward opening of the "C" clip element is preferably closely fitted for receipt of and for flexibly releasable grasping of the necks of common water, soft drink and beer bottles.

A further structural component of the instant inventive bottle carrier comprises attaching and torque relieving means, such means being fixedly attached to or formed wholly with the respective upper and rearward ends of the stay and the bottle support arm. The attaching and torque relieving means preferably forwardly and laterally cantilevers the bottle support arm from the stay's upper end. A preferred attaching and torque relieving means comprises a swivel pin and eye combination, the eye of such combination preferably extending through the upper end of the stay, and the swivel pin preferably being fixedly attached to and extending rearwardly from the rearward end of the bottle support arm. Suitably, the attaching and torque relieving means may alternately comprise a differently configured swivel pin and eye combination wherein the swivel pin is fixedly attached to and extends forwardly from the upper end of the stay, and wherein the eye is fixedly attached to or formed wholly with the rearward end of the bottle support arm. The attaching and torque relieving means may further alternately suitably comprise a swivel pin and socket combination which spans between and similarly torque relievingly interconnects the upper end of the stay and the rearward end of the bottle support arm. Other commonly known swiveling and torque relieving attaching means which may be provided for interconnecting the upper end of the stay and the rearward end of the bottle support arm are considered to fall within the scope of the invention.

In use of the instant inventive bottle carrier, a user may grasp the bottle carrier with, for example, his or her right hand, and may thereafter extend the lower end of the carrier's stay element downwardly into the user's right pants hip pocket until the bottle support arm element immediately overlies and extends laterally rightwardly from the upper opening of such pocket. Thereafter, such user may engage the neck of a common water bottle or soft drink bottle with the carrier's "C" clip element, causing such bottle to securely suspend from the bottle carrier and from the pant's pocket at the user's hip. Such bottle suspension advantageously frees the user's hands from carrying the bottle. Thereafter, the user may briskly walk or run, freely causing the bottle to swing forwardly and rearwardly. Upon such forward and rearward bottle swinging motion, the provided attaching and torque relieving means continues to allow the "C" clip to securely hold the bottle, preventing angular torque or twisting forces from prematurely disengaging the bottle. Upon seating while wearing the inventive bottle carrier, a carried bottle may angularly bias against a seat's surface while the attaching and torque relieving means similarly advantageously preserves the engagement of the bottle's neck with the carrier's "C" clip.

Accordingly, objects of the instant invention include the provision of a bottle carrying device which incorporates elements of the types described above, and wherein such elements are configured and arranged for the performance of beneficial functions as described above.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 2:
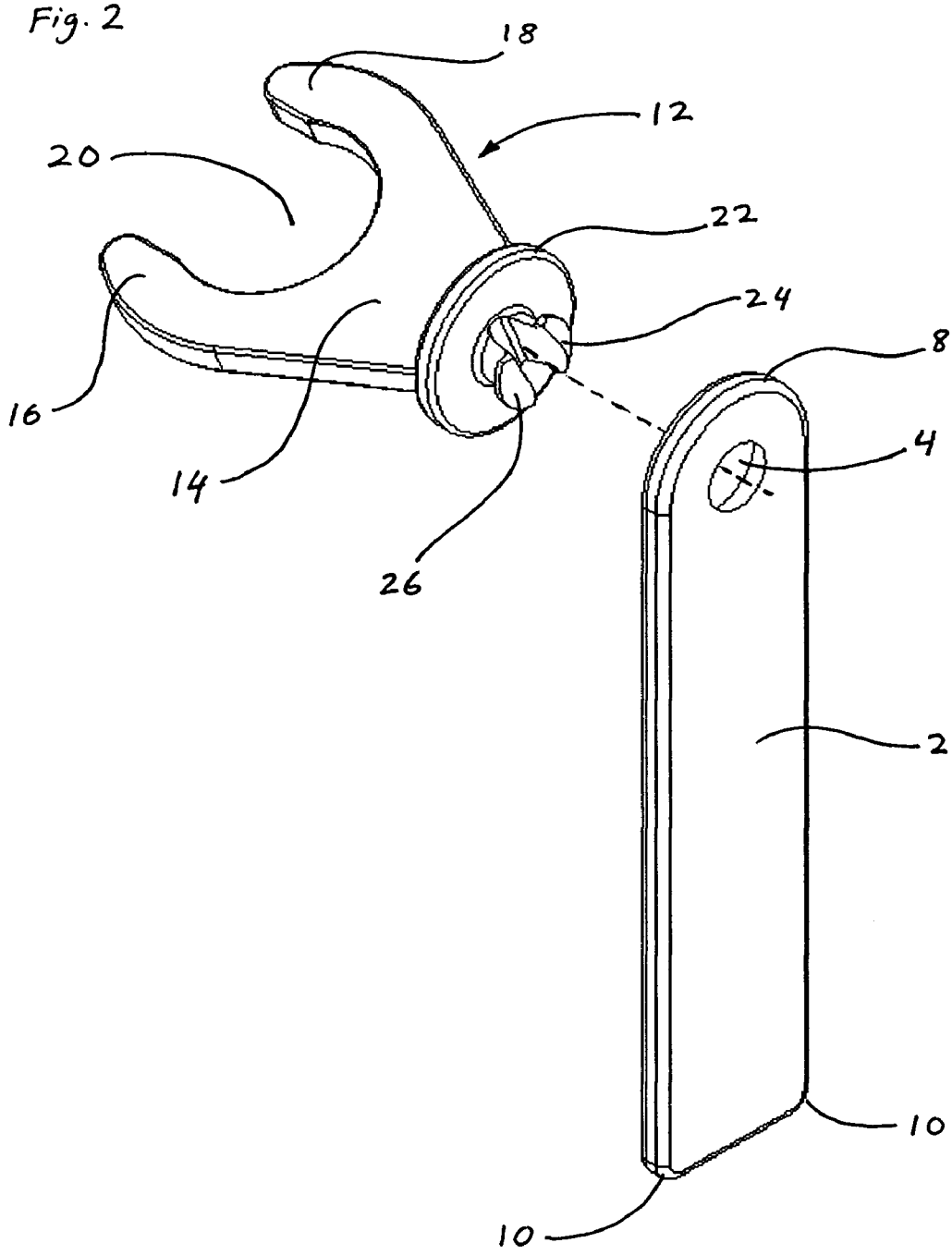
FIG. 2 redepicts FIG. 1, the view of FIG. 2 showing the components of FIG. 1 in an exploded configuration.
Figure 3:
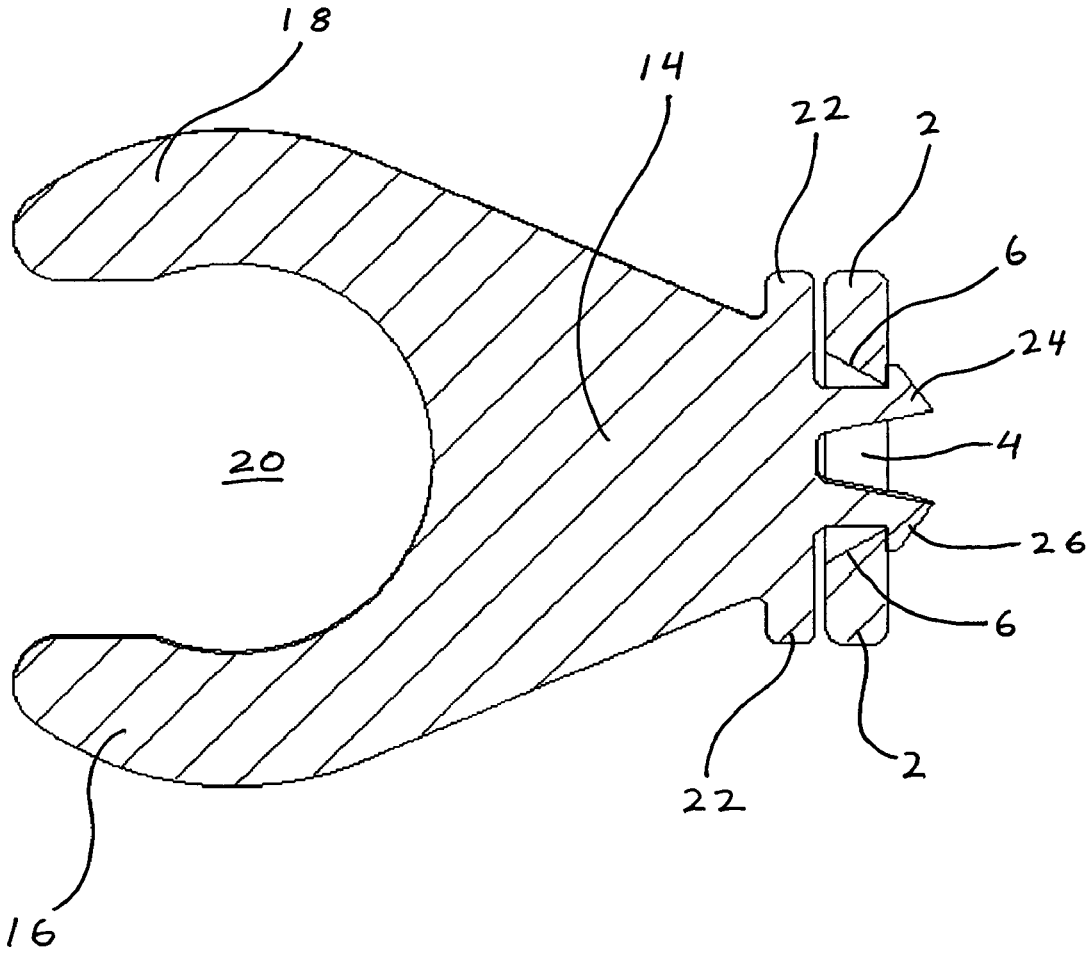
FIG. 3 is a sectional view as indicated in FIG. 1.

Referring now to the drawings, a preferred embodiment of the instant inventive bottle carrier is referred to generally by Reference Arrow 1. The bottle carrier 1 preferably comprises a stay 2. Referring further simultaneously to FIG. 2, the stay 2 preferably has a swivel pin receiving eye 4 extending through its upper end, a rounded upper end 8, and preferably has rounded lower corners 10. Referring further simultaneously to FIG. 3, the eye 4 preferably has a beveled or chamfered annular inner wall 6 whose functions are further described below.

Figure 1:
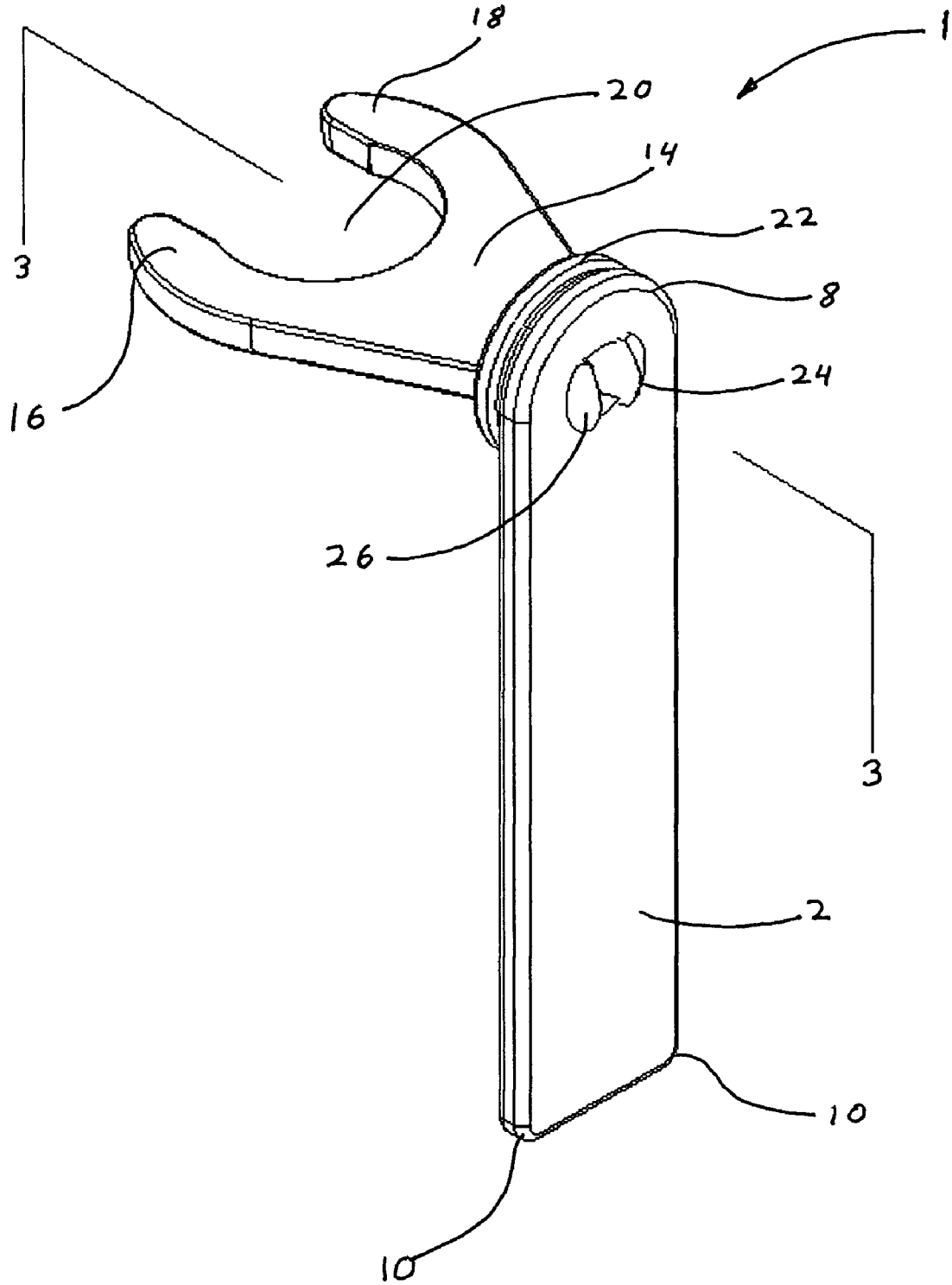
FIG. 1 is an isometric view of a preferred embodiment of the instant inventive bottle carrier.

Referring further simultaneously to FIGS. 1-3, a further structural component of the instant inventive bottle carrier 1 comprises a "C" clip, bottle carrying arm, and swivel pin combination, which combination is referred to generally by Reference Arrow 12. Such combination 12 preferably comprises a cantilevered arm 14, such arm 14 having a "C" clip fixedly attached to or, as depicted, formed wholly with its forward end. The "C" clip preferably comprises left and right fingers 16 and 18, such fingers defining a bottle neck grasping space 20. The swivel pin element of the combination 12 preferably comprises left and right spring hooks 26 and 24, such hooks preferably being fixedly attached to or formed wholly with the rearward end of the bottle support arm 14.

Viewing FIGS. 2 and 3 simultaneously, it can be seen that upon rearward driving of the spring hooks 24 and 26 into and through the eye 4 of the stay 2, the chamfered wall 6 of the eye 4 elastically biases the spring hooks 24 and 26 toward each other from their normal eye latching positions to temporary eye insertion positions. Upon passage of the distal ends of the spring hooks 24 and 26 through eye 4, such hooks securely and permanently engage the eye 4 and the upper end of the stay 2, while allowing the spring hooks 24 and 26 to dually function as a swivel pin for facilitating rotation of the arm 14 and the "C" clip with respect to the stay 2.

Referring simultaneously to FIGS. 1 and 2, in order to prevent excessive downwardly angled displacement of the arm 14 with respect to stay 2 upon carriage of a heavy bottle, a support flange preferably extends downwardly from the forward ends of the spring hooks 24 and 26, such support flange advantageously dually functioning as an eye insertion stop. Advantageously, as depicted in FIGS. 1 and 2, such support flange comprises a completely annularly extending flange 22 for support of the arm 14 regardless of the rotational orientation of the arm 14 with respect to the stay 2.

Figure 4:
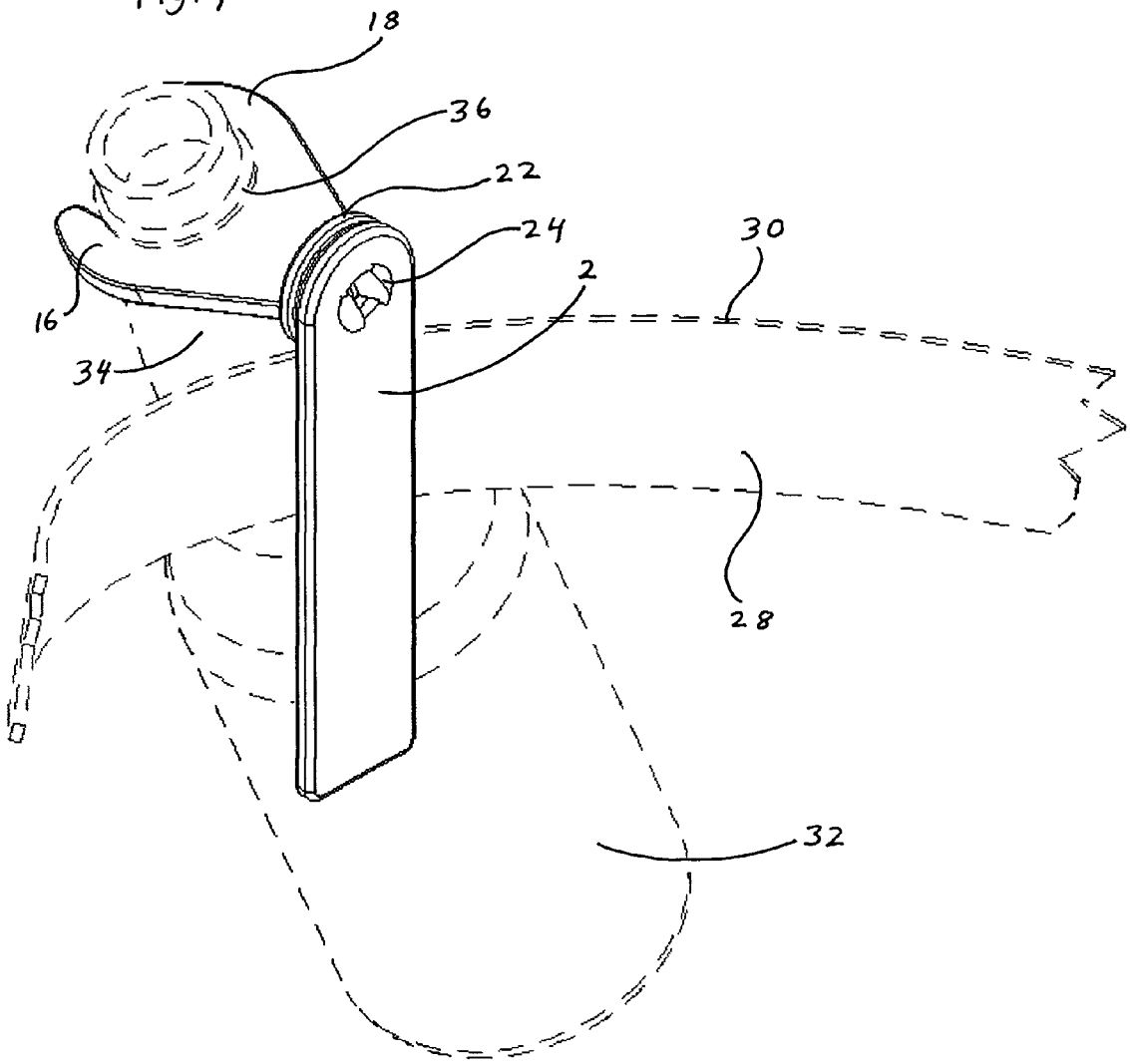
FIG. 4 depicts the inventive bottle carrier in use, the view showing the bottle carrier attached to an exemplary belt and carrying an exemplary beer bottle.
Figure 5:
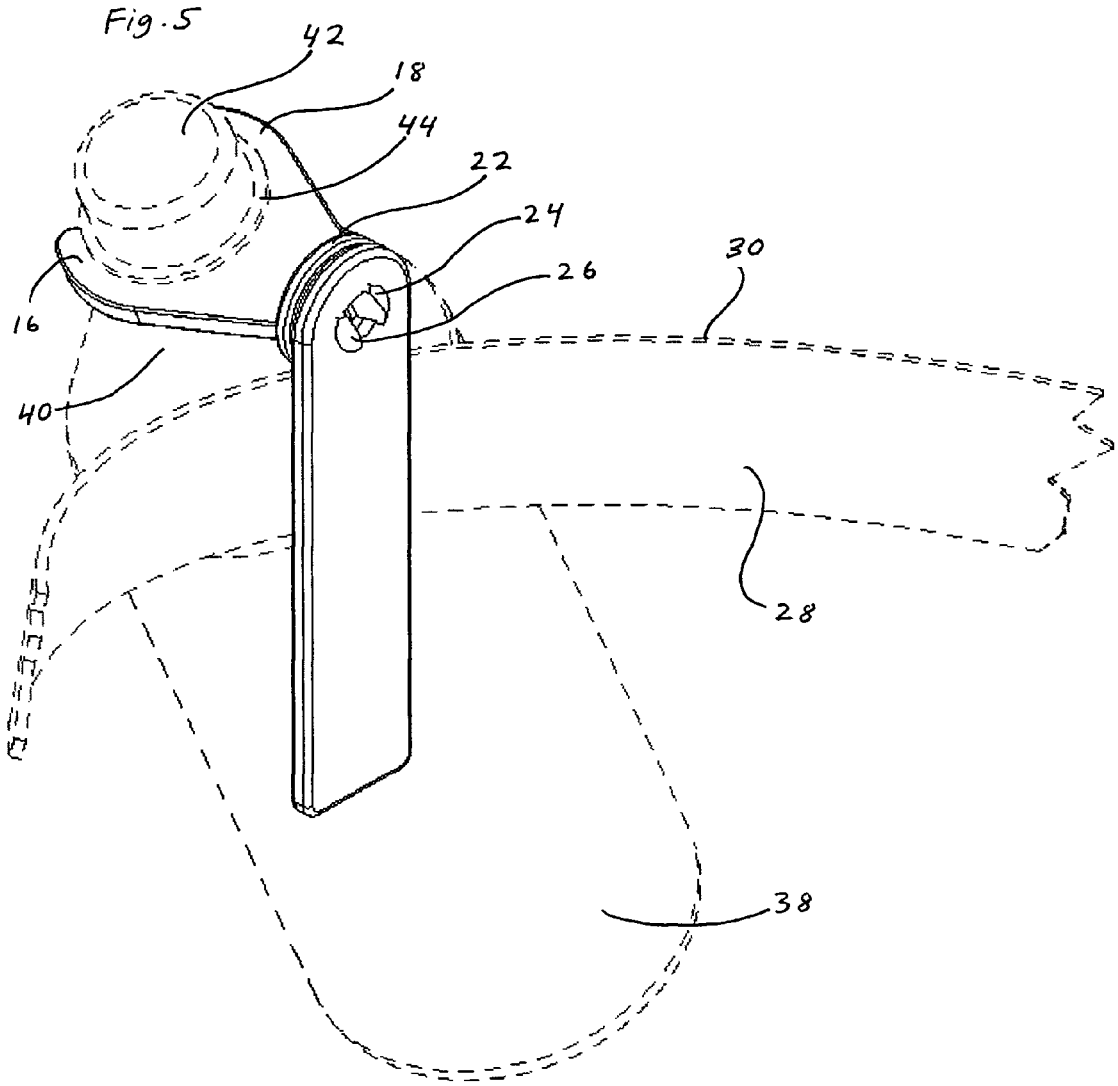
FIG. 5 redepicts FIG. 4, the view showing the inventive bottle carrier alternately carrying a water bottle.

In use of the instant inventive bottle carrier, referring to FIG. 4, a common belt 28 shown in ghost as dashed lines has an upper edge 30. Such upper edge 30 of the belt 28 is intended to also represent an upper opening of a pants hip pocket. In use, the stay 2 may be inserted downwardly behind the belt 28 or into such pant's hip pocket, as the case may be. Upon such insertion, the rounded corners 10 of the stay advantageously prevent snagging or binding of the lower end of the stay 2 against a user's clothing. Upon insertion of the stay 2 behind the belt or into a hip pocket, as applicable, a beer bottle 32 may be moved rearwardly until such bottle's neck 34 contacts the forward ends of the fingers 16 and 18 of the "C" clip of the bottle support arm. Upon further application of rearward pressure, the fingers 16 and 18 temporarily flex away from each other, allowing the "C" clip to receive the bottle neck 34. Upon insertion of the bottle neck 34, the fingers 16 and 18 elastically return to their normal bottle holding positions. While in their normal bottle holding position depicted in FIG. 4, the inner peripheral edges of fingers 16 and 18 bias against an annular flange 36 of the bottle neck 34 for securely holding and suspending the bottle 32. In operation, the bottle 32, along with the arm 14 may pivotally move with respect to the stay 2 without undesirable premature bottle disengagement. Referring further to FIG. 5, an alternate water or soft drink bottle 38 is depicted, such bottle 38 being mounted between fingers 16 and 18 similarly with the beer bottle configuration depicted in FIG. 4. In the configuration of FIG. 5, the "C" clip element of arm 14 grasps bottle neck 40 while the inner peripheral surfaces of fingers 16 and 18 bias against a lower flange 44 of a bottle cap 42.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A bottle carrying assembly comprising:

(a) a bottle having an upper neck portion, an upper end of the bottle's upper neck portion having an annular flange;

(b) a stay having an upper end, and having a lower end;

(c) a bottle support arm having a rearward end and having a forward end;

(d) a "C" clip fixedly attached to or formed wholly with the bottle support arm's forward end, the "C" clip opening forwardly, the "C" comprising left and right fingers, the left and right fingers defining a circular bottle neck grasping space, the "C" clip receiving the bottle's upper neck portion and biasing against the annular flange; and (e) attaching and torque relieving means fixedly attached to or formed wholly with the respective upper and rearward ends of the stay and the bottle support arm, the attaching and torque relieving means forwardly cantilevering the bottle support arm from the stay; the attaching and torque relieving means comprising a swivel pin having a forward end, and further comprising insertion stopping and arm supporting means, the insertion stopping and arm supporting means being fixedly attached to or formed wholly with the forward end of the swivel pin; the insertion stopping and arm supporting means comprising a flange, the flange extending at least downwardly from the forward end of the swivel pin, the attaching and torque relieving means further comprising an eye, wherein the eye extends through the upper end of the stay, wherein the swivel pin rearwardly extends from the rearward end of the bottle support arm, and wherein the swivel pin is received within and rotates within the eye.

2. The bottle carrying assembly of claim 1 wherein the swivel pin comprises a pair of spring hooks, the pair of spring hooks being elastically movable between normal eye latching positions and eye insertion positions, the pair of spring hooks being elastically displaced toward each other while in their eye insertion positions.

3. The bottle carrying assembly of claim 2 wherein eye comprises an annularly chamfered wall, the annularly chamfered wall being oriented for, upon rearward extension of the pair of spring hooks into the eye, biasing the pair of spring hooks toward their elastically displaced eye insertion positions.

4. The bottle carrying assembly of claim 1 wherein the flange further extends annularly about the forward end of the swivel pin.

5. The bottle carrying assembly of claim 1 wherein the stay comprises a vertically oblongated cylinder having a substantially rectangular horizontal cross-sectional profile, the lower end of the stay comprising a pair of rounded corners.

6. The bottle carrying assembly of claim 3 wherein the stay and the bottle support arm comprise injection molded plastic.

7. The bottle carrying assembly of claim 4 wherein the stay and the bottle support arm comprise injection molded plastic.

8. The bottle carrying assembly of claim 5 wherein the stay and the bottle support arm comprise injection molded plastic.

* * * * *